US005375302A

United States Patent [19]

Takamura

[11] Patent Number: 5,375,302

[45] Date of Patent: Dec. 27, 1994

[54] SNAP BUTTON ASSEMBLY

[75] Inventor: Yoshio Takamura, Kurobe, Japan

[73] Assignee: Yoshida Kogyo K.K., Tokyo, Japan

[21] Appl. No.: 153,106

[22] Filed: Nov. 17, 1993

[30] Foreign Application Priority Data

Nov. 20, 1992 [JP] Japan ..... 4-086178[U]

[51] Int. Cl.[5] ..... A44B 1/00

[52] U.S. Cl. ..... 24/90 R; 24/94

[58] Field of Search ..... 24/90 R, 94, 93, 95, 24/90 C, 113 MP

[56] References Cited

U.S. PATENT DOCUMENTS

| | | | |
|---|---|---|---|
| 543,029 | 7/1895 | LeBlanc | 24/90 R |
| 1,467,280 | 9/1923 | Warner | 24/94 |
| 2,242,352 | 5/1941 | Fenton | 24/94 |
| 5,115,548 | 5/1992 | Nysten | 24/95 |

FOREIGN PATENT DOCUMENTS

| | | |
|---|---|---|
| 8811748 | 11/1988 | Germany . |
| 8907590 | 8/1989 | Germany . |
| 63-89 | 1/1988 | Japan . |

*Primary Examiner*—Victor N. Sakran

*Attorney, Agent, or Firm*—Hill, Steadman & Simpson

[57] ABSTRACT

A snap button assembly attaches onto a garment fabric. The snap button assembly has a cap member, a socket member, a tack member releasably engageable with the socket member, and a sealing member adapted to house the socket member. The sealing member has an outer diameter substantially equal to that of the cap member such that the garment fabric is held in place against sagging or separation from around the area to which the button assembly is applied.

7 Claims, 4 Drawing Sheets

SNAP BUTTON ASSEMBLY

BACKGROUND OF THE INVENTION

1. Field of the Invention

The present relates to improvements in and relating to a snap-fit button assembly including a capped button body and a tack member adapted to be joined therewith for attachment of the button to a garment or like articles.

2. Prior Art

A typical conventional snap-fit button is illustrated in FIG. 8 of the accompanying drawings in which the button 100 comprises a dome-shaped cap 101 having a hollow shank 102 and a socket member 103 having a hollow hub 104 defining therein a circular opening 105 for receiving a tack member 106 secured to a web of lining 107 and a circular peripheral flange 107 partially surrounding the hub 104 and terminating radially short of the marginal edge of the cap 101. The shank 102 is pierced through a garment fabric 108 and rivetted in place against the bottom of the hub 104, clinching a portion of the fabric 108 and thus holding the latter between the cap 101 and the socket member 103. A spring member 109 is accommodated in the socket 103 for resilient engagement with the tack member 106. This prior art device has a drawback in that since the socket member 103 is considerably smaller in diameter than the cap 101, there is a tendency of the garment fabric 108 to sag apart or separate from around the cap 101, leaving a gap 110 which is not only unsightly but often catches a fingernail of a user.

The same problem is encountered with a button of the type disclosed in Japanese Utility Model Publication No. 63-89 which involves the use of a button cap larger than a socket member. This button device has a further drawback in that the cap and the socket are loosely connected together in the absence of positive securing means and hence are susceptible to separation.

SUMMARY OF THE INVENTION

With the foregoing drawbacks of the prior art in view, the present invention seeks to provide a snap button assembly which incorporates means for ensuring a perfect seal such that a garment fabric is prevented from being separated from the area at which the button is applied.

The invention further seeks to provide a snap button assembly which has its component parts held together stably in position against displacement or disengagement.

The above and other features and advantages of the invention will be better understood from the following detailed description taken in conjunction with the accompanying drawings. Like reference numerals refer to like or corresponding parts throughout the several views.

A snap button assembly according to the invention comprises a snap button assembly for attachment onto a garment fabric which comprises:

(1) a cap member having a hollow shank;

(2) a socket member having a spring housed therein and including hollow hub for receiving the hollow shank and an annular flange extending radially outwardly from the hub;

(3) a tack member engageable with the spring; and (4) a sealing means adapted to house the socket member and having, an outer diameter substantially equal to that of the cap member the sealing means including a flat circular base portion, a central aperture dimensioned to receive the hub, a circular chamber dimensioned to receive the annular flange and an abutting marginal edge substantially coextensive with the circumferential marginal edge of the cap member.

DETAILED DESCRIPTION OF THE PRESENTLY PREFERRED EMBODIMENTS

Figure 1:
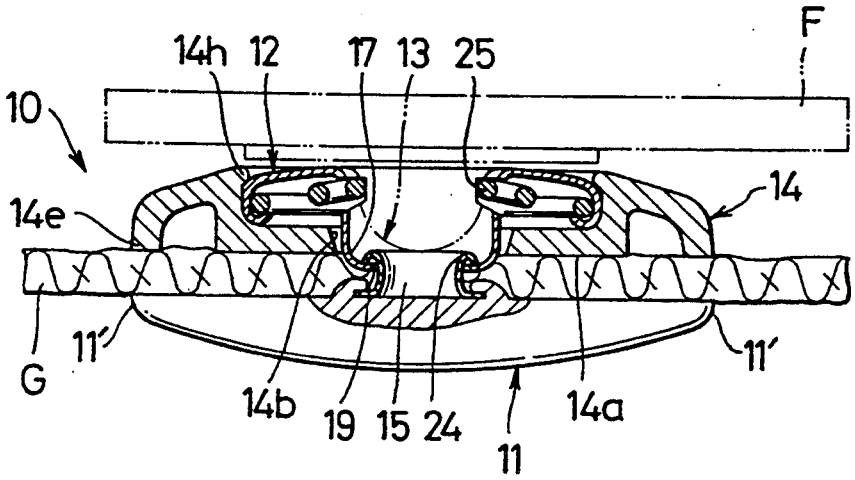
FIG. 1 is a side elevational, partly sectional, view of a snap button assembly embodying the invention shown assembled and attached to a garment fabric.

Referring now to FIG. 1, there is shown a snap-fit button assembly 10 embodying the invention which is shown assembled and attached to a garment fabric G. The button assembly 10 essentially comprises a cap member 11, a socket member 12, a tack member 13 and a sealing means 14.

The cap member 11 is generally dome-shaped as is known with most conventional buttons and has a hollow shank 15 extending axially centrally from a flat bottom surface 16.

Figure 8:
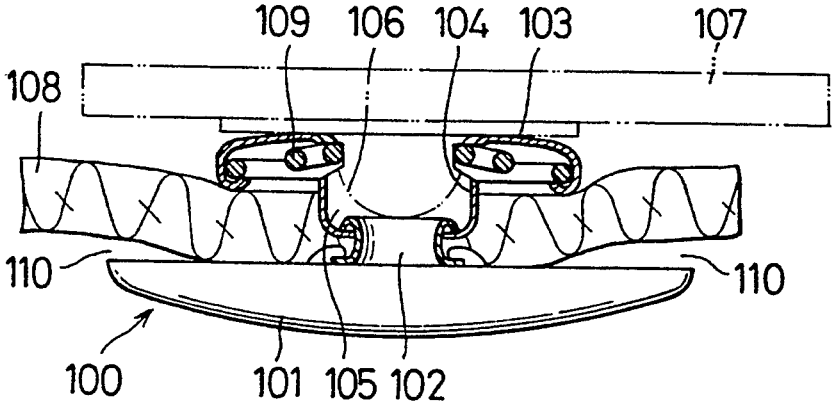
FIG. 8 (PRIOR ART)
FIG. 8 is a side elevational, partly sectional, view of a prior art button.

The socket member 12 has a hollow hub 17 having a circular axial chamber 18 dimensioned to receive the tack member 13 and a circular opening 19 dimensioned to receive the shank 15 of the cap member 11. Extending radially outwardly from the marginal edge of the hub 17 is an annular flange 20 having its peripheral edge folded inwardly as at 21 defining a diameter much smaller than the diameter of the cap member 11 as in the case of the prior art device shown in FIG. 8. Over the folded edge 21 of the annular flange 20 is seated a snap ring 22 adapted to retain the flange 20 in position.

Figure 2:
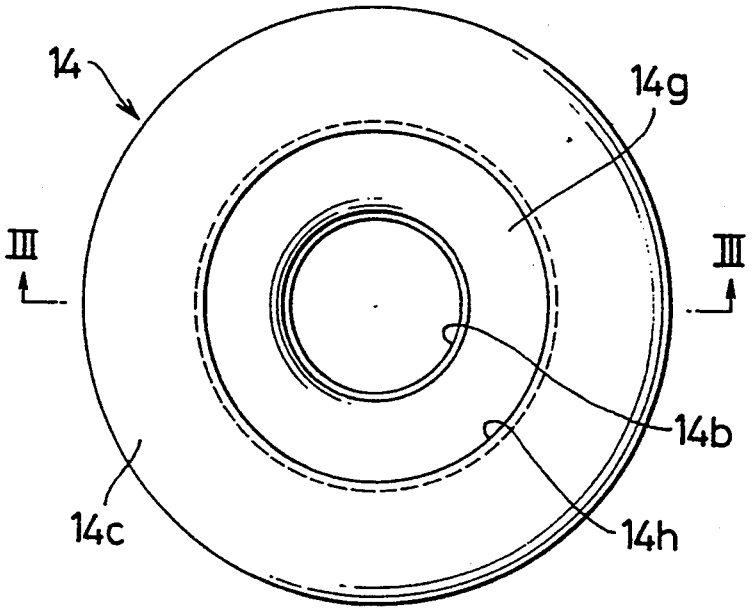
FIG. 2 is a plan view of a sealing means employed in accordance with the invention.

The sealing means 14 takes the form of a dome-shaped disc, as shown in FIG. 2, which is adapted to house therein the socket member 12 and which has an outer diameter substantially equal to that of the cap member 11 as shown in FIG. 1.

Figure 3:
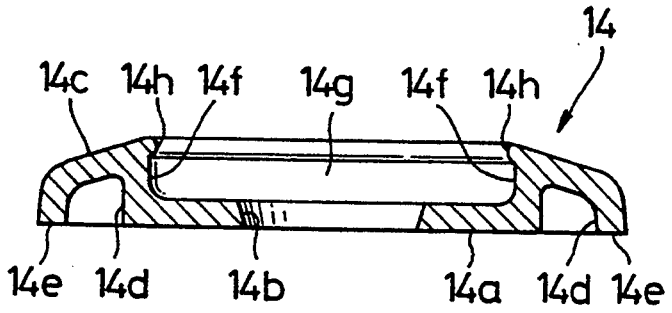
FIG. 3 is a cross-sectional view taken generally along the line III—III of FIG. 2.

As better shown in FIG. 3, the sealing means or disc 14 has a flat circular base portion **14*a* having a central aperture 14*b* dimensioned to receive the hub 17 of the socket member 12 and an annular flange portion 14*c* extending radially outwardly from and beyond the base portion 14*a* to define therewith an annular groove 14*d* and terminating circumferentially at a level flush with the bottom surface of the base portion 14*a*, at which level is formed an abutting marginal edge 14*e* which is substantially coextensive with the circumferentially marginal edge 11' of the cap member 11 and which bites into the material of the garment fabric G when the socket 12 and the cap 11 are coupled together in a manner hereinafter to be described. The flange portion 14b has an inner rise 14f forming a circular chamber 14g in communication with the aperture 14b, the chamber 14g being dimensioned to receive the annular flange 20 of the socket member 12. An annular rim 14h projects from the upper end of the rise 14f radially inwardly and is adapted to retain the socket member 12 in position against disengagement from the sealing disc 14 once the button 10 is assembled as shown in FIG. 1**.

Figure 4:
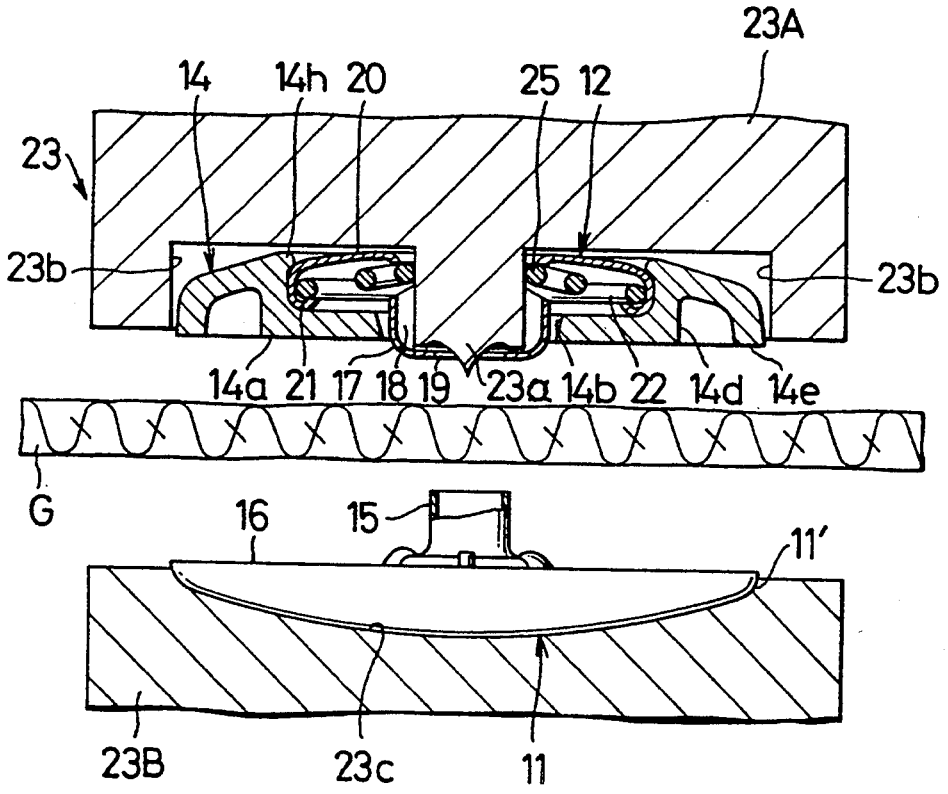
FIG. 4 is a side elevational, partly sectional, view of the button assembly of FIG. 1 shown separated prior to assembling on the garment fabric.

Reference to FIG. 4 shows an anvil device 23 which comprises a first support block 23A having a downwardly extending rivetting head 23a engageable with the hub 17 and a pair of cavities 23b, 23b on opposite sides of the head 23a for receiving the sealing disc 14 as mounted with the socket 12; and a second support block 23B having a cavity 23c configured to receive the cap member 11 with the shank 15 facing toward the rivetting head 23a.

In assembly of the button 10 exclusive of the tack member 13, the first and second blocks 23A, 23B are closed together with the garment fabric G interposed therebetween, in which instance the rivetting head 23a imparts a head rolling action upon the hollow shank 15 of the cap member 11 to cause its marginal edge to be rivetted over around the opening 19 as indicated at 24 in FIG. 1.

With the cap 11 and the socket 12 thus coupled together, the area of the garment fabric G to which the button assembly 10 is applied is held substantially immovable by pressure engagement of the marginal edge 14e of the sealing disc 14 with the fabric, the marginal edge 14e being substantially coextensive with the corresponding circumferential marginal edge of the cap member 11.

Upon removal from the anvil device 23, the button assembly 10 is ready for receptive engagement with the tack member 13 in a manner well known in the art in which the tack member 13 is attached to a mating strip of living or fly F as shown in FIG. 1.

Designated at 25 is a compression spring housed in the socket member 12 adapted to snap the tack member 13 into and out of the socket member 12.

Figure 5:
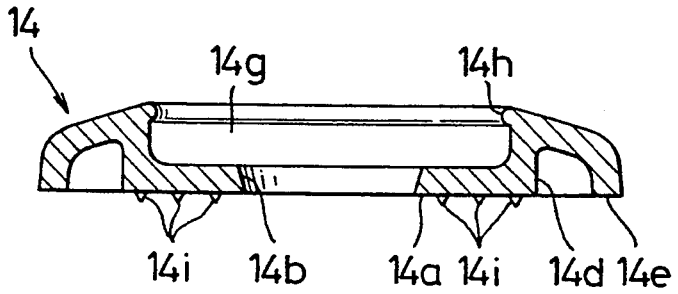
FIGS. 5 and 6 are views similar to FIG. 3 but showing respective modified forms of sealing means.

FIG. 5 shows a modified form of sealing means 14 which is similar in construction to the sealing means 14 shown in FIG. 3 except that there are provided a plurality of pointed projections 14c extending outwardly from the base portion 14a for biting engagement with the material of the garment fabric G.

Figure 6:
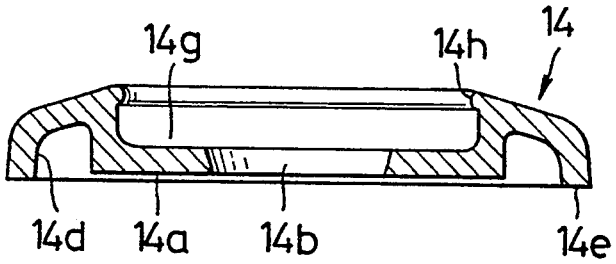

FIG. 6 shows another modified sealing means 14 in which the abutting marginal edge 14e extends sightly outwardly beyond the lower surface of the base portion 14a to provide enhanced biting engagement with the garment fabric G.

Figure 7:
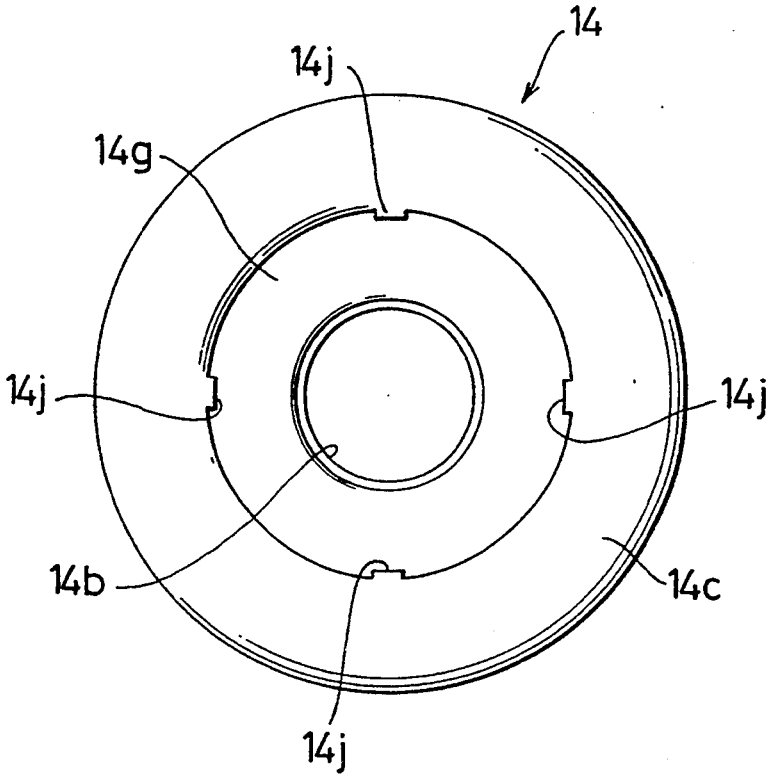
FIG. 7 is a view similar to FIG. 2 but showing a further modification of sealing means.

FIG. 7 shows a further modified sealing means 14 in which there are provided a plurality of retaining lugs 14j equally spaced apart around and extending radially inwardly from the circumferential edge of the chamber 14g for firmly retaining the socket member 12 in position against disengagement from the sealing disc 14.

Obviously, various modifications and variations of the present invention are possible in light of the above teaching. It is, therefore, to be understood that, within the scope of the appended claims, the invention may be practiced otherwise than as specifically described.

What is claimed is:

1. A snap button assembly for attachment onto a garment fabric, the assembly comprising:

(1) a cap member having a hollow shank;

(2) a socket member having a spring housed therein and including a hollow hub for receiving said hollow shank and an annular flange extending radially outwardly from said hub;

(3) a tack member engageable with said spring; and (4) a sealing means adapted to house said socket member and having a flat circular base portion, a central aperture dimensioned to receive said hub, a circular chamber dimensioned to receive said annular flange and an abutting marginal edge engageable with said fabric.

2. The snap button assembly according to claim 1 wherein said sealing means has an outer diameter substantially equal to that of said cap member, and said abutting marginal edge is substantially coextensive with the circumferential marginal edge of said cap member.

3. The snap button assembly according to claim 1 wherein said sealing means is in the form of a dome-shaped disc.

4. The snap button assembly according to claim 1 wherein said abutting marginal edge extends outwardly beyond said base portion.

5. The snap button assembly according to claim 1 wherein said sealing means has a plurality of projections extending from said base portion.

6. A snap button assembly for attachment onto a garment fabric, the assembly comprising:

(1) a cap member having a hollow shank;

(2) a socket member having a spring housed therein and including a hollow hub for receiving said hollow shank and an annular flange extending radially outwardly from said hub;

(3) a tack member engageable with said spring; and (4) a sealing means adapted to house said socket member and having a flat circular base portion, a central aperture dimensioned to receive said hub, a circular chamber dimensioned to receive said annular flange and an abutting marginal edge engageable with said fabric wherein said sealing means includes an annular rim projecting inwardly from said circular chamber.

7. A snap button assembly for attachment onto a garment fabric, the assembly comprising:

(1) a cap member having a hollow shank;

(2) a socket member having a spring housed therein and including a hollow hub for receiving said hollow shank and an annular flange extending radially outwardly from said hub;

(3) a tack member engageable with said spring; and (4) a sealing means adapted to house said socket member and having a flat circular base portion, a central aperture dimensioned to receive said hub, a circular chamber dimensioned to receive said annular flange and an abutting marginal edge engageable with said fabric wherein said sealing means has a plurality of retaining lugs spaced apart around and extending radially inwardly from said circular chamber.

* * * * *